United States Patent [19]

Cohen et al.

[11] 4,355,265

[45] Oct. 19, 1982

[54] DISCHARGE LAMP STARTING AND OPERATING CIRCUIT

[75] Inventors: Sheppard Cohen, Danvers; Nikolaos Barakitis, Haverhill; Alexander T. Zack, Danvers, all of Mass.

[73] Assignee: GTE Products Corporation, Stamford, Conn.

[21] Appl. No.: 216,876

[22] Filed: Dec. 15, 1980

[51] Int. Cl.[3] ..... H05B 37/00

[52] U.S. Cl. ..... 315/290; 315/46; 315/47

[58] Field of Search ..... 315/46, 290, 73; 337/22

[56] References Cited

U.S. PATENT DOCUMENTS

| | | | |
|---|---|---|---|
| 1,374,647 | 4/1921 | Gimingham | 315/46 |
| 1,881,975 | 10/1932 | Spaeth | 315/290 |
| 2,286,789 | 6/1942 | Dench | 315/47 |
| 2,294,623 | 9/1972 | Lebrun | 315/290 |
| 2,441,796 | 5/1948 | Campbell | 315/47 |
| 2,748,315 | 5/1956 | Martin et al. | 315/290 |

*Primary Examiner*—Harold A. Dixon

*Attorney, Agent, or Firm*—Edward J. Coleman

[57] ABSTRACT

A circuit for starting and operating a low wattage high intensity discharge lamp from a source of AC line voltage. The circuit includes a glow starter device having a first terminal connected to a first bimetal, a second terminal connected to a second bimetal, and third terminal connected to a rigid conductive member, the bimetals being electrically connected together at one end which makes a normally closed contact with the rigid member in the quiescent state of the device. A choke coil and a capacitor are series connected in that order between one of the AC input terminals and the second terminal of the starter device, and a second AC input terminal is connected to the third terminal of the starter. The first and third terminals of the starter device are connected across the discharge lamp terminals. Upon initial energization of the circuit, short circuit current flows through the second and third terminals of the starter device to cause flexing of the second bimetal for separating the bimetals from the rigid member to provide an open circuit thereat and a switching transient across the lamp. Upon starting of the lamp, the lamp current flow through the first and second terminals of the starter device is operative to maintain the bimetals separated from the rigid member.

12 Claims, 2 Drawing Figures

DISCHARGE LAMP STARTING AND OPERATING CIRCUIT

BACKGROUND OF THE INVENTION

This invention relates to discharge lamp starting and operating circuits, and more particularly to an improved circuit for efficiently starting and operating low wattage, high intensity discharge lamps.

Conventional ballast circuits for operating high intensity discharge lamps have been constructed from leakage reactance transformers and reactors and may or may not include a spike or pulse starter. Typically, the discharge current through the lamp is controlled by the inductive reactance of the transformer core at a 60 Hz line frequency. As will be discussed hereinafter, such ballasts are not particularly suitable for the much smaller size, lower wattage high pressure metal halide arc discharge lamps currently being introduced. For example, one such lamp is discussed in U.S. Pat. No. 4,161,672, which also describes the use of double-ended arc tubes for such lamps. Further, a copending application U.S. Ser. No. 132,933, filed Mar. 24, 1980 and assigned to the present assignee, describes a low wattage metal halide arc discharge lamp having a press-sealed single-ended arc tube, that is to say, an arc tube in which both electrodes are located in a press-seal at one end of the arc tube. Practical designs of such lamps have ranged from 100 watts to less than 10 watts. The approximate electrical characteristics of one such lamp, for example, are 50 volts, 1 ampere, 40 watts.

Considering the aforementioned characteristics of a low wattage lamp, one would ordinarily think that the most desirable ballast to use on 120 volt, 60 Hertz lines would be the simple reactor. The reactor has the advantages of low cost, low loss, small size and weight and good lamp operation. This type of ballast is applicable where line voltage is sufficient to start the lamp. If necessary, a starting device, such as a pulse starter, is often used to facilitate starting such as with high pressure sodium lamps.

Although a low wattage discharge lamp, such as that described in the aforementioned copending application Ser. No. 132,933, ignites under these conditions, great difficulty is exhibited in making the glow-to-arc discharge transition. An obvious way to improve the transition process is to increase the open circuit voltage; for example, increasing the voltage to approximately 240 volts by autotransformer action solves this problem. Such a solution, however, although technically satisfactory, increases the size, cost and especially the losses to a degree that the low wattage high intensity discharge lamp loses its attractiveness as a product.

SUMMARY OF THE INVENTION

Accordingly, it is an object of the present invention to provide an improved circuit for starting and operating a high intensity discharge lamp.

A particular object of the invention is to provide an economical and efficient ballast and starting system that ignites a low wattage discharge lamp, facilitates the transition from glow-to-arc, and operates the lamp satisfactorily.

These and other objects, advantages and features are attained, in accordance with the invention, by a circuit comprising, in combination, first and second input terminals for connection to a source of AC line voltage, a ballast circuit, and a current responsive starter means including a normally closed switching means coupled across the terminals of the discharge lamp. The ballast circuit comprises an inductive means and a capacitive means series connected in that order between the first AC input terminal and one side of the starter means and providing a lead circuit ballast for the lamp. Means is provided for connecting the second AC input terminal to the other side of the starter means, whereby the normally closed state of the switching means thereof provides a short circuit between the capacitive means and the second AC input terminal. Upon initial energization of the circuit, the starter means is responsive to the short circuit current therethrough to provide an open circuit at the switching means thereof and produce a high voltage pulse switching transient across the lamp. Upon starting of the lamp, the starter means is responsive to the lamp current flow therethrough to maintain the open circuit state of the switching means thereof.

In a preferred embodiment, the starter means comprises a glow starter device having a first terminal connected to a first bimetal, a second terminal connected to a second bimetal, and a third terminal connected to a rigid conductive member, the bimetals being electrically connected together at one end which makes a normally closed contact with the rigid member in the quiescent state of the device. The ballast circuit comprises an inductive means and a capacitive means series connected in that order between the first AC input terminal and the second terminal of the starter device. Means is provided for connecting the second AC input terminal to the third terminal of the starter device, and means are provided for connecting the first and third terminals of the starter device across the terminals of the discharge lamp. Upon initial energization of the circuit, short circuit current through the second and third terminals of the starter device is operative to flex the second bimetal for separating the bimetals from the rigid member to provide an open circuit thereat and produce a high voltage pulse switching transient across the lamp. Upon starting of the lamp, the lamp current flow through the first and second terminals of the starter device is operative to maintain the bimetals separated from the rigid member.

In a preferred embodiment, the lamp is a low wattage high intensity discharge lamp, and the ballast circuit comprises the series combination of a reactor and capacitor which provides a lead circuit, the capacitive reactance being approximately twice the inductive reactance.

The circuit does not function properly with the aforementioned low wattage discharge lamps if only a reactor ballast is used. In the case of a reactor ballast without a series capacitor, ignition may take place but the glow-to-arc discharge transition becomes extremely unreliable. The capacitor is quite necessary as it appears to cooperate with the starter and reactor to provide a voltage increasing effect for successfully providing the requisite glow-to-arc transition.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
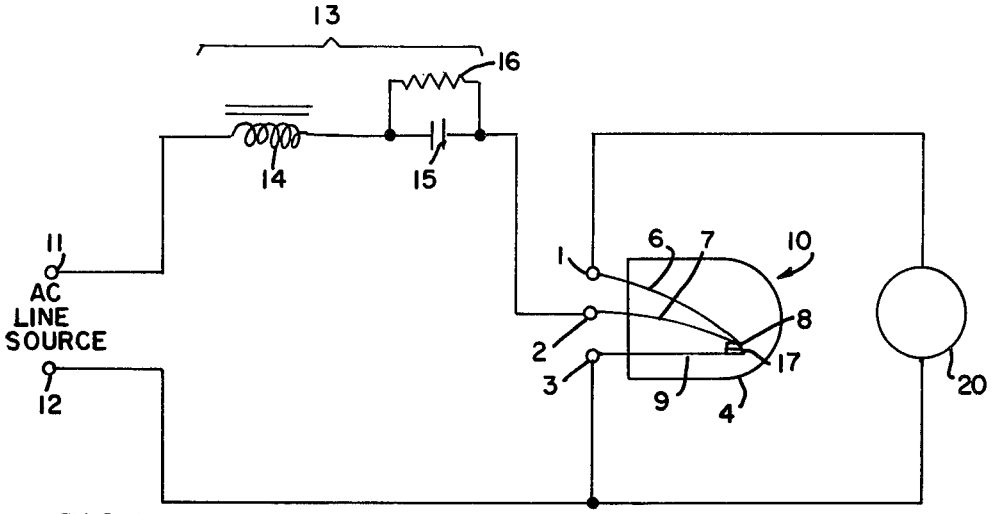
FIG. 1 is a circuit diagram of a lamp starting and operating circuit showing an embodiment of the invention.

Referring to FIG. 1, there is shown a circuit diagram illustrating an embodiment of a comparatively simple ballast and starting system, according to the invention, for igniting, facilitating transition from glow-to-arc, and operating a high intensity discharge lamp 20, particularly a low wattage metal halide arc discharge lamp of the type described in the aforementioned copending application Ser. No. 132,933. The system includes a lead circuit ballast 13 in combination with a shorting-starting switch 10. The input terminals 11 and 12 of the circuit are connected to an AC line source, e.g., 120 volts, 60 Hertz. The lead circuit ballast 13 is comprised of an inductive reactor 14, such as a choke coil, and a capacitor 15 series connected in that order between the AC input terminal 11 and terminal 2 of the starter device 10. A discharge resistor 16 is connected across capacitor 15. AC input terminal 12 is connected to terminal 3 of the starter device 10, and terminals 1 and 3 of the starter are connected across the terminals of the discharge lamp 20.

The capacitive reactance of capacitor 15 is selected to be approximately twice the inductive reactance of reactor 14. Preferably, the capacitance of capacitor 15 should be approximately 10.5 microfarads or higher.

Figure 2:
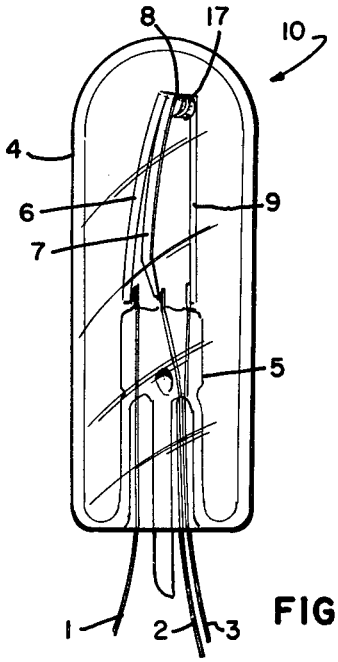
FIG. 2 is an elevational view of a glow starter device suitable for use in the circuit of FIG. 1.

The starter 10 may be similar to that described in copending application Serial No. (D-22,706), filed concurrently herewith and assigned to the present assignee. More specifically, referring to FIG. 2, a preferred type of starter is a glow starter device comprising two bimetals 6 and 7, and a rigid conductive member 9 disposed within an hermetically sealed envelope 4 which is filled with a gas at subatmospheric pressure. Three lead-in wires respectively connected both mechanically and electrically to the bimetals and rigid conductive member extend through a reentrant stem 5 sealed at the bottom of the lamp envelope 4. Lead-in wire 1 is connected to bimetal 6; lead-in wire 2 is connected to bimetal 7; and lead-in wire 3 is connected to the conductive member 9. The two bimetals 6 and 7 are electrically connected together at one end and attached to a contact button 8, such as by welding. A mating contact button 17 is welded to the end of the conductive member 9. In the quiescent state of the device, the bimetals 6 and 7 resiliently urge button 8 to make a normally closed contact with the button 17 of the rigid member 9. Hence, at normal room temperature and in the absence of current flowing through either of the bimetals, starter 10 provides a normally closed switch across both the lamp 20 and the output of the ballast circuit, represented by the AC input and lead circuit 13.

Referring now to the operation of the circuit of FIG. 1, upon initial energization of the circuit with AC input power, ballast short circuit current is drawn through starter terminal 2, bimetal 7, rigid member 9 and starter terminal 3. The resulting $I^2R$ in the bimetal 7 is sufficient to cause the necessary heat to flex both of the bimetals 7 and 6 so as to separate and open the contacts 8 and 17. When this open circuit occurs at the starter 10, the current drawn from the lamp ballast 13 rapidly decreases and the inductive output of the ballast generates a high voltage pulse, thereby producing a switching transient across the lamp which provides sufficient energy to initiate discharge in the lamp 20. If for some reason the discharge lamp 20 does not start when the contacts 8 and 17 open, no current is drawn through the bimetals 6 and 7 whereupon the bimetals cool and relax until the contacts 8 and 17 reclose the starter switch. Heating of bimetal 7 again occurs causing the bimetals to flex and again open the starter contacts, whereupon another high voltage starting pulse is generated. This starting process is repeated until a discharge is initiated in the lamp 20. When the lamp is ignited, current is drawn through both of the bimetals 6 and 7, the $I^2R$ of which is sufficient to maintain the bimetals separated from the rigid member 9 and thereby keep the contacts 8 and 17 open.

It is clear that the glow starter 10 is a current responsive device as opposed to the conventional voltage type glow starters. Operation of the starter 10 is not a function of the open circuit voltage, rather the $I^2R$ deflecting function is responsive to short circuit current. The device works in circuits having low open circuit voltages where more common glow bottle starter techniques have not been able to be utilized.

The voltage levels in the ballast system should not exceed the rated values, typically about 4000 volts for the aforementioned low wattage discharge lamps. The amplitude of the high voltage pulse generated by the starter switch is given by Ldi/dt where L is the output impedance of the reactor 14, di is the change in current when the starter contacts are open, and dt is the time required for di to occur. Thus, the amplitude of the pulse can be controlled either by controlling the current through the closed starter contacts or by controlling the speed at which the starter contacts open. It has been found that the amplitude of the starter pulse can be further controlled via the glow starter device 10 by selection of the glow-bottle gas and pressure. Further, as this high voltage pulse is generated when the starter contacts open, it is clear that the pulse occurs at a random time during the AC cycle of the lamp voltage.

In regard to the aforementioned transient high voltage switching pulse across the lamp, we have made some interesting observations. If the circuit of FIG. 1 is employed with only a reactor, i.e., without a capacitor 15, generation of a high voltage pulse will not reliably ignite the lamp 20, even though the pulse amplitude (L di/dt) is identical to that of a FIG. 1 circuit including a capacitor. More specifically, we have found that this is due to the fact that making the transition within the lamp from the glow to the arc state is quite critical. More specifically, we have found that in the case of a reactor ballast without a series capacitor, ignition of the lamp may take place but the transition becomes extremely unreliable. Hence, the capacitor 15 is quite necessary for the glow-to-arc transition to take place. The capacitor, together with the starter and reactor, appears to provide a voltage increasing effect in the circuit.

More specifically, when the bimetals 6 and 7 of the starter 10 provide a closed circuit via rod 9, and the capacitive reactance of capacitor 15 is approximately twice the inductive reactance of reactor 14, there is somewhat of a rise in the voltage across the capacitor. The voltage across capacitor 15 is changing at 60 times per second with a somewhat flattened sinusoidal waveform. At the specific point in time that the starter contacts are open, there is a voltage across the capacitor 15. For example, say that the starter contacts are opened at zero current, such that di/dt equals zero. There is a finite voltage across the capacitor, across the open starter contacts, and across the lamp. We have a capacitor voltage with the AC line voltage superimposed thereacross. Accordingly, there is a voltage increasing effect of the AC line over the capacitor DC voltage. Hence, with the opening of the starter contacts plus the high voltage across the capacitor, we effectively provide a voltage increasing circuit which makes possible a transition from the glow-to-arc state.

In a specific implementation, the envelope 4 of the starter 10 was formed of soda lime glass, and the reentrant stem 5 was lead glass. Lead-in wires 1–3 were nickel. Bimetals 6 and 7 comprised strips of Chase 6650 material having a thickness of 0.004 inch, a width of 0.040 inch and a length of ⅝ inch. Rigid member 9 was a tungsten rod having a diameter of 0.045 inch and a length of ⅝ inch. Contacts 8 and 17 were silver-plated copper, and the tension provided by the bimetals was about 4 grams. The envelope 4 had an outside diameter of 15 millimeters and a length of 40 millimeters and was filled with an atmosphere of argon gas at a pressure of about 4 torr. The starter device was designed to handle about 0.8 ampere.

Reactor 14 comprised a 320 millihenry choke wound about an iron core and having an inductive reactance of about 110 ohms. Resistor 16 had a value of 2.7 megohms, ½ watt. Capacitor 15 had a value of 11.5 microfarads, 230 volts, and provided a capacitive reactance of about 230 ohms. Lamp 20 was a low wattage, metal halide high intensity discharge lamp having approximate electrical characteristics of 50 volts, 1 ampere, 40 watts.

Although the invention has been described with respect to a specific embodiment, it will be appreciated that modifications and changes may be made by those skilled in the art without departing from the true spirit and scope of the invention. For example, in the case of the specifically illustrated starter device, the two bimetals may be formed from a single strip which is separated longitudinally for a substantial portion of its length; accordingly, the connection at one end would be the unseparated portion of the strip. Further, the circuit may employ a normally closed current responsive starter device other than the specific type illustrated; e.g., a single bimetal device with a proximate heater resistor, such as described in a copending application Ser. No. 139,310, filed Apr. 11, 1980 and assigned to GTE Laboratories Incorporated.

We claim:

1. A lamp starting and operating circuit comprising, in combination:

first and second input terminals for connection to a source of AC line voltage;

a glow starter device having a first terminal connected to a first bimetal, a second terminal connected to a second bimetal, and a third terminal connected to a rigid conductive member, said bimetals being electrically connected together at one end which makes a normally closed contact with said rigid member in the quiescent state of said device;

an inductive means and a capacitive means series connected in that order between said first AC input terminal and the second terminal of said starter device;

means connecting said second AC input terminal to the third terminal of said starter device; and means for connecting the first and third terminals of said starter device across the terminals of a discharge lamp, whereby upon initial energization of said circuit, short circuit current through the second and third terminals of said starter device is operative to flex said second bimetal for separating said bimetals from said rigid member to provide an open circuit thereat and produce a high voltage pulse switching transient across the lamp, and upon starting of said lamp, the lamp current flow through the first and second terminals of said starter device is operative to maintain said bimetals separated from said rigid member.

2. The circuit of claim 1 wherein said lamp is a low wattage high intensity discharge lamp.

3. The circuit of claim 1 wherein said starter device further includes an hermetically sealed envelope within which said bimetals and said rigid member are disposed, and said envelope is filled with a gas at subatmospheric pressure, the amplitude of said pulse being controlled by the selection of said gas and pressure.

4. The circuit of claim 1 wherein said series combination of the inductive and capacitive means provides a lead circuit, and the capacitive reactance of said capacitive means is approximately twice the inductive reactance of said inductive means.

5. The circuit of claim 4 wherein said inductive means is a reactor and said capacitive means is a capacitor series connected with said reactor.

6. The circuit of claim 5 wherein said reactor is a choke coil.

7. The circuit of claim 6 wherein a discharge resistor is connected across said capacitor.

8. The circuit of claim 5 wherein the capacitance of said capacitor is at least about 10.5 microfarads.

9. A starting and operating circuit for a low wattage high intensity discharge lamp comprising:

first and second input terminals formed for connection to a source of AC line voltage;

a series-connected inductive and capacitive means connected in that order to said first input terminal; and a current-responsive starter means including a normally-closed (N/C) switching means having a pair of contact buttons, said starter means having a first bimetal coupling one of said pair of contact buttons to said capacitive means, a second bimetal coupling said one of said contact buttons to one terminal of said lamp, and an electrical conductor coupling the other one of said pair of contact buttons to said second input terminal and to the other terminal of said lamp whereby current flow from said capacitive means through said first bimetal contact buttons and electrical conductor to said second input terminal causes said first bimetal to flex and separate said contact buttons and current flow through said first and second bimetals to said lamp maintains said bimetals flexed and said contact buttons separated.

10. The circuit of claim 9 wherein the capacitive reactance of said capacitive means is approximately twice the inductive reactance of said inductive means.

11. The circuit of claim 9 wherein a discharge resistor is connected across said capacitor.

12. The circuit of claim 9 wherein the capacitance of said capacitor is at least about 10.5 microfarads.

* * * * *